US009464605B2

(12) United States Patent
Peterson

(10) Patent No.: US 9,464,605 B2
(45) Date of Patent: Oct. 11, 2016

(54) QUAD FLOW TORQUE ENHANCEMENT FLOW DIVIDER CAUSING IMPROVED FUEL/AIR TRANSFER

(71) Applicant: Lonn M. Peterson, Richmond, MN (US)

(72) Inventor: Lonn M. Peterson, Richmond, MN (US)

( * ) Notice: Subject to any disclaimer, the term of this patent is extended or adjusted under 35 U.S.C. 154(b) by 543 days.

(21) Appl. No.: 13/975,287

(22) Filed: Aug. 24, 2013

(65) Prior Publication Data

US 2015/0052748 A1 Feb. 26, 2015

(51) Int. Cl.
*F02M 35/00* (2006.01)
*F02M 35/10* (2006.01)
*F02M 19/08* (2006.01)

(52) U.S. Cl.
CPC ..... *F02M 35/10019* (2013.01); *F02M 19/08* (2013.01); *Y10T 29/49231* (2015.01)

(58) Field of Classification Search
CPC ..... F02M 35/10019; F02M 19/08; Y10T 29/49231
See application file for complete search history.

(56) References Cited

U.S. PATENT DOCUMENTS 1,382,285 A * 6/1921 Harris ..... F02M 26/19 123/556
1,503,371 A * 7/1924 Meyer ..... F02M 1/00 123/585
2,377,088 A * 5/1945 Linn ..... F02M 1/00 48/189.4
3,952,776 A 4/1976 Eversole et al.
3,982,504 A * 9/1976 Noguchi ..... F02B 19/1066 123/260
4,114,580 A * 9/1978 Coats ..... F02M 29/04 123/593
4,295,458 A * 10/1981 Pellerin ..... F02M 29/04 123/548
4,359,035 A * 11/1982 Johnson ..... F02M 29/04 123/573
4,384,563 A * 5/1983 Siefer ..... F02M 29/04 123/549
4,491,106 A 1/1985 Morris
4,492,212 A * 1/1985 Dooley ..... F02M 29/04 123/184.39
4,620,951 A 11/1986 Makino et al.
4,667,648 A * 5/1987 Beldin ..... F02M 29/04 123/593
4,971,730 A * 11/1990 Edmonston ..... F02M 9/06 261/44.3
5,027,754 A * 7/1991 Morone ..... F01L 3/205 123/184.54

(Continued)

*Primary Examiner* — Hieu T Vo
*Assistant Examiner* — Sherman Manley
(74) *Attorney, Agent, or Firm* — David George Johnson

(57) ABSTRACT

A wing (1) including a vertical plate (2) and a horizontal plate (3) is placed in the throat of a carburetor (41) or throttle body (93). The wing (1) is located adjacent to and downstream from the throttle valve (46, 94). The edges (6, 7, 13, and 131) are held in a spaced apart relationship from the carburetor wall (44) by locating tabs (4, 14, 15 and 16) which abut the wall (44). Securing tabs (5, 24) extend from the edges and grip a gasket or boot associated with an existing intake manifold. The wing (1) causes the air/fuel mixture exiting a carburetor to follow channelized parallel paths (78, 81 and 84) into the intake manifold.

16 Claims, 17 Drawing Sheets

(56) References Cited

U.S. PATENT DOCUMENTS 5,113,838 A * 5/1992 Kim ..... F02M 29/06 123/590
5,342,555 A * 8/1994 Edmonston ..... F02M 29/04 261/44.3
5,636,612 A 6/1997 Brucato
5,685,281 A * 11/1997 Li ..... F02M 29/06 123/590
5,718,198 A 2/1998 Adamisin
5,758,614 A * 6/1998 Choi ..... F02D 9/104 123/184.53
5,879,595 A 3/1999 Holtzman
5,924,398 A * 7/1999 Choi ..... F02D 9/104 123/184.21
6,041,753 A * 3/2000 Lin ..... F02M 29/06 123/306
6,076,499 A * 6/2000 Klumpp ..... F02D 9/101 123/306
6,158,412 A * 12/2000 Kim ..... F02M 29/06 123/306
6,227,185 B1 * 5/2001 Spracher ..... F02B 31/04 123/590
6,257,212 B1 * 7/2001 Hammond ..... F02M 29/02 123/557
6,612,295 B2 * 9/2003 Lerner ..... F02M 35/10078 123/593
7,111,607 B2 9/2006 Oota
7,131,514 B2 * 11/2006 Choi ..... F01N 1/083 123/184.21
7,322,333 B2 * 1/2008 Isaji ..... F02B 31/06 123/184.51
7,325,538 B2 * 2/2008 Bean ..... F02M 29/06 123/306
7,458,344 B2 * 12/2008 Holtorf ..... F02B 25/24 123/65 V
7,556,031 B2 * 7/2009 Russell ..... B01F 5/061 123/306
7,665,442 B1 2/2010 Levitz et al.
7,690,349 B2 4/2010 Bolanos
7,743,756 B2 * 6/2010 Styles ..... F02D 9/1035 123/568.17
7,762,229 B2 * 7/2010 Abe ..... F02B 31/06 123/306
8,051,846 B2 * 11/2011 Sugishita ..... F02M 29/14 123/184.22
8,141,538 B2 * 3/2012 Yang ..... F02M 29/04 123/184.21
8,166,775 B2 * 5/2012 Choi ..... B60H 1/00564 181/224
8,220,444 B2 7/2012 Cheung et al.
8,844,492 B2 * 9/2014 Free ..... F02M 35/116 123/184.31
2001/0050075 A1 * 12/2001 Lerner ..... F02M 35/10078 123/593
2003/0150439 A1 * 8/2003 Hsu ..... F02M 29/04 123/592
2003/0226539 A1 * 12/2003 Kim ..... B01F 5/0618 123/306
2004/0031471 A1 * 2/2004 Leuenberger ..... F02M 29/06 123/590
2004/0065296 A1 * 4/2004 Arimatsu ..... F02B 31/04 123/308
2004/0255660 A1 * 12/2004 Abdolhosseini ..... F02M 33/00 73/114.32
2006/0150811 A1 * 7/2006 Callahan ..... B01D 53/0415 95/146
2007/0044780 A1 * 3/2007 Yamamoto ..... F01L 3/205 123/593
2007/0266989 A1 * 11/2007 Yang ..... F02M 29/06 123/306
2010/0031920 A1 * 2/2010 Chien ..... F02B 31/04 123/306
2010/0031921 A1 * 2/2010 Rarick ..... F02D 9/101 123/337
2010/0154756 A1 * 6/2010 Chien ..... F02B 29/02 123/559.1
2010/0266395 A1 * 10/2010 Hermann ..... F02B 37/00 415/191
2013/0047960 A1 * 2/2013 Yamamoto ..... F02M 35/10281 123/445
2013/0125861 A1 * 5/2013 Yamamoto ..... F02M 69/00 123/445
2013/0255616 A1 * 10/2013 Yao ..... F02M 35/104 123/184.21

* cited by examiner

FIGURE 6
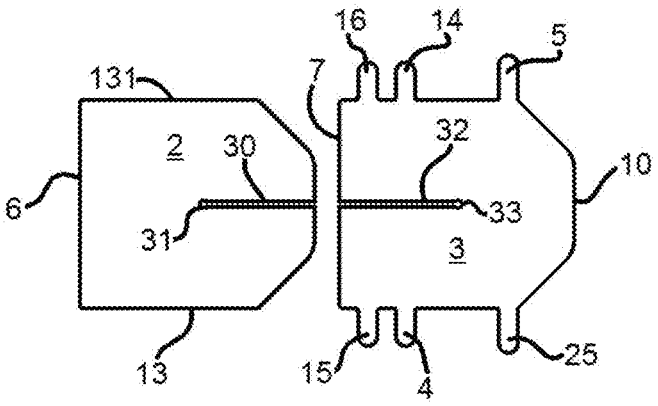
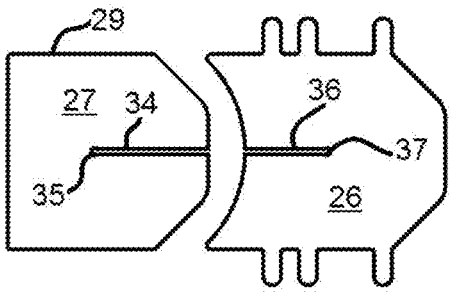
FIGURE 7

PRIOR ART

PRIOR ART

QUAD FLOW TORQUE ENHANCEMENT FLOW DIVIDER CAUSING IMPROVED FUEL/AIR TRANSFER

This patent application is based on Provisional Patent Application No. 61/699,293, filed on Sep. 11, 2012.

FIELD OF THE INVENTION

The present invention pertains generally to the field of carburetion and fuel injection, and more particularly to the transport of the fuel/air mixture.

BACKGROUND OF THE INVENTION

A carburetor or a fuel injector is a device that causes the creation of a mixture of fuel and air in a predictable and efficient ratio. In the case of a carburetor fuel is introduced into an air volume which is subsequently transported to the combustion space within a cylinder. In the case of a fuel injector the fuel is sometimes injected directly into the cylinder combustion space, but in other situations is injected into an air volume that is then sent to the cylinder as is typical with carburetion systems. In either case, the fuel/air ratio is dependent on throttle setting.

Controlling airflow volume and velocity within a carburetor largely determines the parameters relating to throttle response, engine power, fuel atomization, specific fuel consumption and the operating consistency of the engine. When an engine is operated at a constant throttle setting under a constant load and in constant atmospheric conditions, the carburetor can be of a simple design while still permitting the engine to operate efficiently. In the real world of motor vehicle operation the load changes frequently as the vehicle accelerates, decelerates and changes elevation. Maintaining the appropriate airflow volume and velocity under these changing conditions is extremely challenging.

The basic problem of carburetor air flow and fuel mixture dynamics may be better understood with reference to FIGS. 10 and 11. A prior art carburetor 41 is depicted in FIG. 10 with the throttle slide 46 shown in an approximately half open position. As the throttle slide is moved in the direction of arrow 54 the throttle is moved towards a further closed position, thereby further restricting the amount of air passing through the carburetor. Atmospheric air enters the inlet 51 of the carburetor, travelling generally in the direction of arrow 52. Initially the paths followed by the air, such as paths 53, 59 and 60 are substantially parallel, but as the carburetor inlet wall 61 narrows in cross sectional width, and the air encounters the lower edge 62 of the throttle slide 46, the path followed by any molecule of air becomes substantially different from other air molecules. As the air passes over float bowl 43, fuel particles, such as fuel particle 57, initially travelling in the direction of arrow 55 are entrained in the flowing air to form the fuel/air mixture needed for engine combustion.

The fuel/air mixture is actually composed of many closely adjacent air molecules and fuel particles, all travelling through the carburetor along diverse paths. For example, path 59 represents a region of air molecules that travel along a relatively straight path 58 at a relatively constant velocity. The adjacent path 60 follows a completely different path 63 in which the velocity changes dramatically along the path 63. The amount of fuel entrained along either path 59 or 60 cannot be calculated with precision. Complicating matters is the creation of voids such as region 56, in which the velocity of the air/fuel mixture may be relatively low while the fuel/air density in region 56 may be relatively high. The result is a nonlinear throttle response as the slide 46 is moved, along with an unpredictable interaction with any reversionary wave generated during the combustion process.

The prior art carburetor 41 is depicted in FIG. 11 with the throttle slide 46 shown in an approximately fully open position. The air entering along path 59, instead of following the relatively constant path 58 shown in FIG. 10 instead follows a much more circuitous path 64. The air entering along path 60 follows a relatively less circuitous path than in the case depicted in FIG. 10. The entrained fuel particle 67 may be substantially identical to the fuel particle 57 shown in FIG. 10, but may also be substantially different in size and velocity at a similar point with respect to the carburetor float bowl 43. A void region 66 is present in a different location than the previously cited void region 56. In other words, the movement of the throttle slide 46 creates a substantially different dynamic of fuel/air mixture flow due to turbulence within the carburetor 41, a condition which is only made less predictable by the introduction of relatively more turbulent flow within the carburetor by any means.

Another device used to create an air/fuel mixture for use in an internal combustion engine is the throttle body 93 as illustrated in FIGS. 14, 15 and 16. The throttle body controls air flow to an intake manifold by operating a butterfly valve 94 within a generally cylindrical housing 95. Air enters through a front or upstream opening 97 and exits the housing 95 via downstream opening 96. A throttle position sensor 98 controls the position of the butterfly valve 94 in response to a signal from or mechanical interaction an accelerator or other throttle control accessible to the operator of a vehicle.

A prior art throttle body 93 is depicted in FIG. 17 with the butterfly valve 94 shown in an approximately half open position. As the butterfly valve is moved in the direction of arrow 99 the throttle is moved towards a further closed position, thereby further restricting the amount of air passing through the throttle body. Atmospheric air enters the inlet 97 of the throttle body, travelling generally in the direction of arrow 100. Initially the paths followed by the air, such as paths 101, 102 and 103 are substantially parallel, but as the carburetor inlet wall 104 narrows in cross sectional width, and the air encounters the leading edge 105 of the butterfly valve 94, the path followed by the air becomes substantially different for each molecule.

For example, path 101 represents a region of air molecules that travel along a relatively straight path 106 at a relatively constant velocity. The adjacent path 102 follows a longer path 107. Path 103 follows a substantially more circuitous path in which the velocity changes dramatically along the path 108. The presence of the valve 94 creates voids such as region 109, resulting in a nonlinear throttle response as the valve 94 is moved, along with the unpredictable influence exerted on any reversionary wave generated during the combustion process.

The prior art throttle body 93 is depicted in FIG. 18 with the butterfly valve 94 shown in an approximately fully open position. The air entering along path 110, instead of following the relatively constant velocity path 106 shown in FIG. 17 instead follows a much more circuitous path 111. The air entering along path 112 follows a relatively less circuitous path than in the case depicted in FIG. 17 for entry path 103. A void region 113 is present in a substantially similar location to the previously cited void region 109. The rotation of the valve 94 creates a different level of turbulence within the air flow due to turbulence within the throttle body 93, a condition which is not predictable and which is not conducive to creating an orderly exit of air from the throttle body outlet 96.

Numerous devices have been developed for placement within the fuel/air transport stream to address the problems caused by variations in throttle setting and the load placed on the engine. A common theme in such devices is a belief that the creation of relatively greater turbulence within the air/fuel will promote better combustion and fuel economy. For example, U.S. Pat. No. 3,952,776, entitled "Fluid Flow Device", inserts a variable cross section member into the throat of a carburetor in an effort to increase air flow velocity on the intake side of the carburetor.

U.S. Pat. No. 4,359,035, entitled "Intake Manifold Fuel Atomizing Screen", uses a mechanical strainer 11 in an effort to create a homogenous fuel/air mixture on the intake side of the carburetor. The strainer is three dimensional and can incorporate various geometries. This device is supposed to redirect the flow in numerous directions, including upstream.

U.S. Pat. No. 4,491,106, entitled "Throttle Configuration Achieving High Velocity Channel at Partial Opening", presents numerous butterfly valve geometries to increase intake airflow.

U.S. Pat. No. 4,620,951, entitled "Slideable Throttle Valve Assembly for a Carburetor and Associated Method of Operation", discloses a slide valve that attempts to improve performance by improving the seal between the slide valve and the groove within which the slide valve operates. This arrangement theoretically forces the intake air to flow under the valve and theoretically prevents intake air from flowing around the sides of the valve.

U.S. Pat. No. 5,636,612, entitled "Adjustable Air Velocity Stacks for Two Stroke Fuel Injected Engines" discloses a slideable throttle plate defined by front and rear surfaces 38 and 40 which permit a series of ports 52-62 to be opened or closed to a desired degree.

U.S. Pat. No. 5,718,198, entitled "Slide Throttle Valve for an Engine Intake System" discloses a sliding throttle plate 26 which includes a series of openings 28 that are followed by a series of tubular channels 18 that lead to the intake plenum 23. The channelized or at least separated flow follows a plate that serves as a throttle adjustment.

U.S. Pat. No. 5,879,595, entitled "Carburetor Internal Vent and Fuel Regulation Assembly" discloses a vent within a carburetor that constantly monitors air pressure within the carburetor and adjusts airflow in response thereto. The '595 carburetor does not use a throttle valve. U.S. Pat. No. 7,111,607, entitled, "Air Intake Device of Internal Combustion Engine" discloses an engine intake device in which a cylinder head has two intake ports that are divided by a partition that divides the intake ports into upper and lower passages. U.S. Pat. No. 7,665,442 "Throttle Plate for use with Internal Combustion Engine" discloses vortex generators 14 that surround an airflow passageway to create turbulence.

While the '198 and '612 patents show a throttle plate followed by channels, neither is used within a carburetor and both require the use of a perforated throttle plate. The '035 patent creates the most turbulent flow possible while introducing some pressure loss in the system, and fails to control or direct the turbulent flow in any predictable manner. These characteristics also true of the '442 patent, although a well defined vortex possesses more predictable airflow effects than a screen or baffle.

U.S. Pat. No. 7,690,349, entitled "Throttle Body Spacer for use with Internal Combustion Engines" discloses four fins placed in the fuel/air flow path immediately following the throttle. The fins are bent or twisted in an effort to create a circular or spiral flow in the region following the spacer. This mechanism is intended to promote relatively more thorough fuel atomization. U.S. Pat. No. 8,220,444, entitled "System for Improving the Efficiency of an Internal Combustion Engine of a Vehicle", discloses a set of curved longitudinal fins within the intake and exhaust manifold intended to accelerate airflow to and from the engine.

The prior art discloses many attempts to realign the airflow through a carburetor throat. Efforts to increase turbulence are frequently presented in a mistaken effort to promote mixing of air and fuel in a process analogous to stirring. Unfortunately, efforts to create turbulence tend to create an unpredictable array of voids and eddies which do not promote either mixing or a predictable throttle response. What is not disclosed in the prior art is a method of consistently forming and controlling channelized, laminar airflow at a relatively low Reynold's Number in the region immediately following the throttle plate and regardless of throttle position.

SUMMARY OF THE INVENTION

The present invention is a torque wing or blade that is installed on the engine side of a carburetor throttle slide. In a preferred embodiment the torque wing divides the carburetor bore into four quadrants, utilizing a horizontal and vertical air stabilizer.

At partial throttle settings of a sliding throttle plate, these stabilizers substantially reduce losses attributable to air turbulence created by a relatively low air flow tumbling into the relatively large volume of the carburetor throat. The reduction in volume or the throat region that is created by the present invention increases air velocity to the engine, improving fuel atomization and engine output power. The flow divider may be used in association with both two and four cycle engines.

The present invention is compatible with engine intake systems including reed valve, piston port or rotary valve. During the operation of an internal combustion engine, relatively turbulent reversionary pulse waves are formed that travel through the engine intake path residing between the engine and the carburetor. The present invention substantially reduces the turbulence associated with the pulse, thereby permitting the pulse to return relatively rapidly to the engine intake manifold and in a relatively orderly state subsequent to reflection from the carburetor output region.

In a typical slide throttle carburetor, any throttle position at half throttle or less normally creates a substantial reduction in throat air velocity. This velocity reduction is due to some portion of the air flow that passes under the carburetor slide being allowed to enter the full size of the carburetor bore, thereby producing turbulence and a corresponding drop in air velocity. The horizontal stabilizer of the present invention reduces this drop in air velocity, thereby producing quicker throttle response and an increase in engine torque. The present invention reduces multidirectional turbulence throughout the full range of throttle travel.

The present invention creates a small space between the stabilizer edges and the carburetor throat wall to equalize and improve stability of the air flow to each of the four quadrants. A portion of the leading edges of the stabilizers protrude past the end of the carburetor throat and extends into the engine intake manifold. The extended edges promote stability of the air column and delay deterioration of the airflow into a turbulent state. In a typical reed valve engine, the travelling air column is relatively stable throughout the entire path between the carburetor and the reed valve.

The present invention typically includes four locating tabs to permit mounting within the carburetor. Two additional tabs are used to prevent the flow divider from twisting and to permit attachment to the rubber intake manifold boot for added security. Typically the wing is constructed from stainless steel and is thus relatively impervious to rust, corrosion, fuel or additives.

The flow divider is installed in the bore of the carburetor between the engine side of the carburetor slide and an intake device such as a conventional intake valve that is common on all four cycle engines, reed valve, rotary valve and piston port. The present stabilizer extends beyond the end of the carburetor. The present invention is applicable to two or four cycle engines or any other number of cycles as occurs, for example, with rotary engines. The invention is a fixed position airflow stabilizer using a horizontal airflow stabilizer and an orthogonal vertical airflow stabilizer, thereby dividing the carburetor bore into four quadrants.

Carburetors nominally of a specific size vary in actual dimensions due to manufacturing tolerances. In order to achieve an accurate fit and secure installation, locating tabs on integrally formed on the edge of the stabilizer that can be formed and adjusted to accommodate an accurate fit. In some cases the present invention also includes lock tabs that fit into two small notches which the installer forms into the carburetor body. The lock tabs prevent the flow divider from rotating, twisting or generally moving. The lock tabs extend beyond the outside diameter of the carburetor body further locking the torque wing into position by providing a slight interference fit into the rubber manifold which holds the carburetor to the engine.

The flow divider typically abuts or is immediately adjacent to the carburetor bore along substantially the total length of the bore. The flow divider preserves a small distance between the carburetor slide and the flow divider in order to prevent both mechanical and fluid flow interference between the two structures.

Insofar as the flow divider affects airflow into the engine as well as reversionary pulse waves of the reflected fuel/air mixture flow, all four quadrants are ideally fully charged and processing airflow. In order to accomplish this goal a space is preserved between the inside diameter of the carburetor bore and the flow divider. A space is also preserved between the carburetor slide and the flow divider. This spacing allows all four quadrants to equalize, charging each chamber or quadrant to maximum capacity. The invention increases fuel efficiency through superior fuel atomization. This causes the engine to be less sensitive to temperature and altitude changes and fuel quality changes. An increase in fuel mileage derived from reduced specific fuel consumption, or an increase in available engine power at a given throttle setting is the apparent result of utilizing the present invention.

BRIEF DESCRIPTION OF THE DRAWINGS

FIG. 6 an exploded view of the torque wing depicted in FIG. 4;

FIG. 7 is an exploded view of a torque wing depicted in FIG. 2;

DETAILED DESCRIPTION OF THE INVENTION

Figure 1:
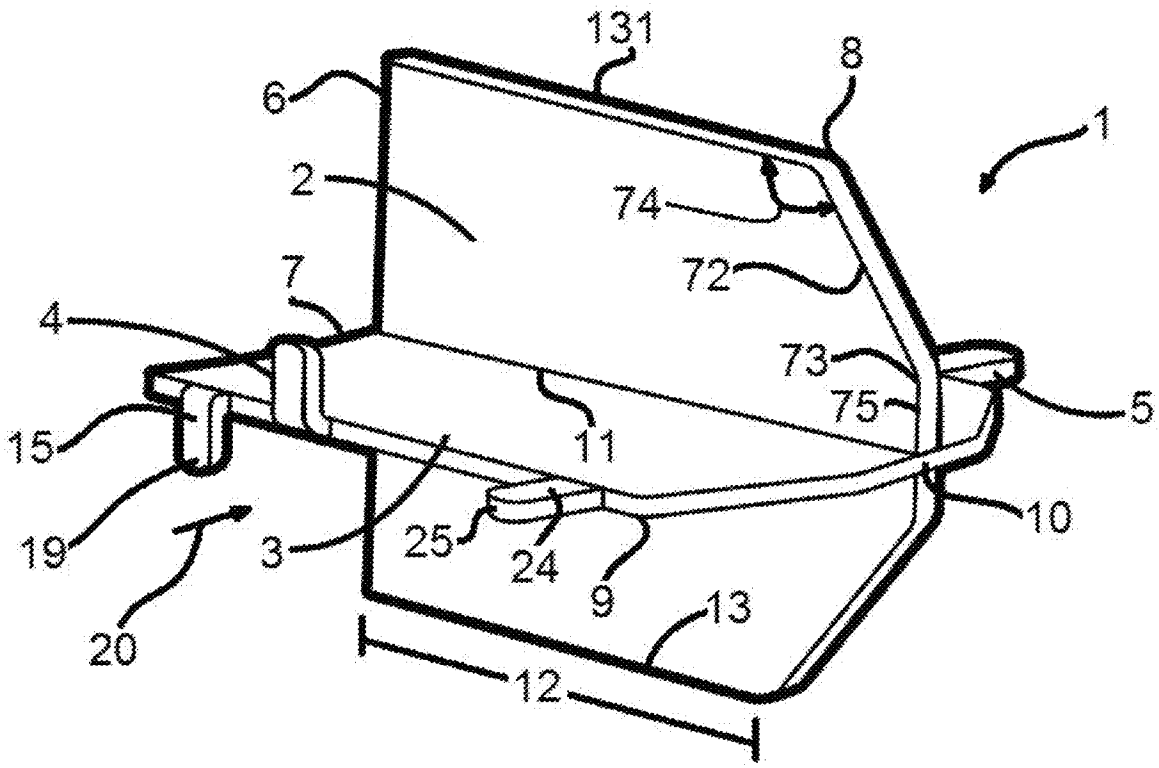
FIG. 1 is a perspective view of a torque wing constructed according to the principles of the present invention.

FIG. 1 depicts one embodiment of the torque wing 1 of the present invention. The torque wing 1 is formed to include a vertical plate 2 and a horizontal plate 3. Referring also to FIG. 6, the vertical plate 2 includes a centrally located slit 30 that terminates at orifice 31. Similarly, the horizontal plate includes a centrally located slit 32 which terminates at orifice 33. By aligning the two slits 30 and 32 and advancing the plate 2 until the orifices 31 and 32 abut, the two plates 2 and 3 create seam 11, thereby permitting the plates 2 and 3 to be rigidly affixed to each other by some convenient means such as welding or brazing. The torque wing 1 may also be formed by a molding or machining process. The plates 2 and 3 are positioned so as to be substantially orthogonal. The leading edge 6 of vertical plate 2 and the leading edge 7 of the horizontal plate 3 are substantially coplanar. The vertical plate 2 includes an upper edge 131 and a substantially parallel lower edge 13, each having a length 12 that is approximately ninety five percent of a distance between a carburetor slide and the downstream exit from a carburetor throat.

The upper edge 131 extends beyond a corner 8 and transitions to a sloped edge 72. The sloped edge resides at an angle 74 of approximately forty five degrees with respect to upper edge 131, terminating at corner 73. The trailing edge 75 begins at the corner 73 until reaching the intersection 10 of vertical plate 2 and horizontal plate 3. The trailing edge 75 is substantially orthogonal to the upper edge 131.

The placement within a carburetor throat of the torque wing 1 is somewhat critical in order to achieve the full operational advantages of the present invention. In order to properly secure and position the torque wing 1, a series of locating and securing extensions or tabs are integrally formed on the edges of the horizontal plate 3.

Figure 4:
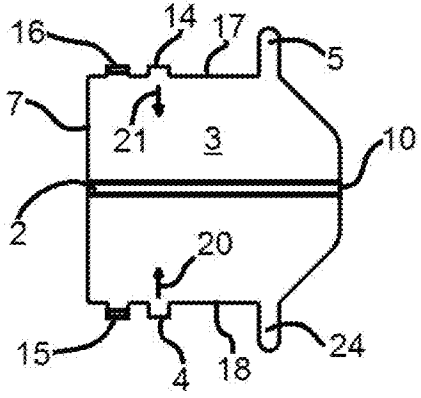
FIG. 4 is a top plan view of an embodiment of the torque wing of FIG. 1 constructed for use in association with a flat carburetor slide.
Figure 5:
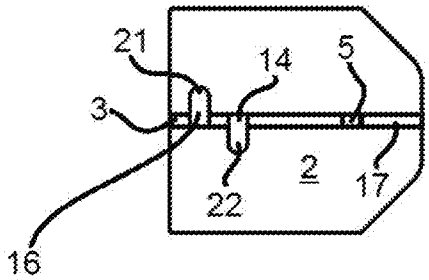
FIG. 5 is a side elevation view of the torque wing depicted in FIG. 4.

Referring also to FIGS. 4 and 5, the horizontal plate 3 includes a left edge 17 and a right edge 18. In order to preserve the necessary spacing between the edges 13, 131, 17 and 18 and the walls of a carburetor throat or bore, a first pair of opposed locating tabs 4 and 14 extend generally upwardly from the edges 18 and 17, respectively, of the horizontal plate 3. A second pair of locating tabs 15 and 16 extends generally downwardly from the edges 18 and 17, respectively, from the horizontal plate 3. The tabs are affixed to the edges of the horizontal plate 3 in a cantilevered fashion, thereby permitting deflection of the tip of the tab. For example, the tab 15 includes a tip region 19. When the torque wing 1 is inserted into a carburetor throat, the tip region 19 is free to deflect inwardly in the direction of arrow 20. Tab 4 is also free to deflect in the direction of arrow 20. Similarly the tip regions 21 and 22 of the tabs 16 and 14, respectively, located on the left edge 17 are free to deflect in the direction of arrow 21 as the tabs 14 and 16 abut the wall of a carburetor bore.

In order to secure the torque wing 2 to an adjoining carburetor or air intake manifold boot, and thus prevent sliding of the torque wing 2 within a carburetor throat, securing tabs 5 and 24 extend outwardly from edges 17 and 18, respectively. The tabs have a tip region, such as tip region 25, which is suitably shaped and dimensioned to fit or protrude into a rubber seal that is typically found at the interface between the downstream carburetor exit and the upstream intake manifold entrance.

Figure 2:
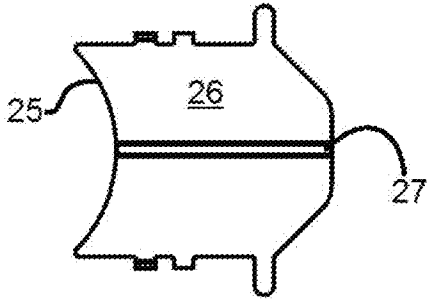
FIG. 2 is a top plan view of an embodiment of the torque wing of FIG. 1 constructed for use in association with a round carburetor slide.
Figure 3:
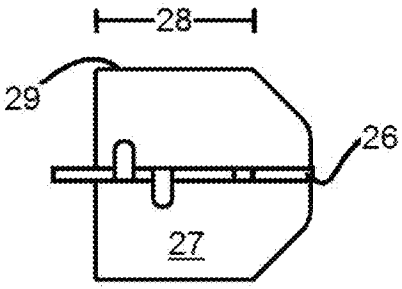
FIG. 3 is a side elevation view of the torque wing depicted in FIG. 2.

The torque wing 1 may be modified to accommodate different carburetor geometries. Referring to FIGS. 2 and 3, for example, the torque wing 1 has been modified to permit installation of the torque wing within the bore of a carburetor that uses a round slide throttle control. In order to accommodate the round slide, the leading edge 25 of the horizontal plate 26 is formed as an arc which resides in a uniformly spaced apart relationship from an adjacent round slide. Similarly, the upper edge 29 of the vertical plate 27 has a length 28 that is short enough to prevent any discontinuity in the leading edge 25 of the horizontal plate 26.

As seen in FIG. 7, the torque wing 1 as modified for a round slide throttle is formed with a the vertical plate 27 that includes a centrally located slit 34 that terminates at orifice 35. Similarly, the horizontal plate 26 includes a centrally located slit 36 which terminates at orifice 37. The two plates 26 and 27 are joined to create an integrated structure by aligning and advancing the slit 34 into the slit 36 so as to form an orthogonal relationship and then securing the two plates together by welding or brazing, for example.

Figure 8:
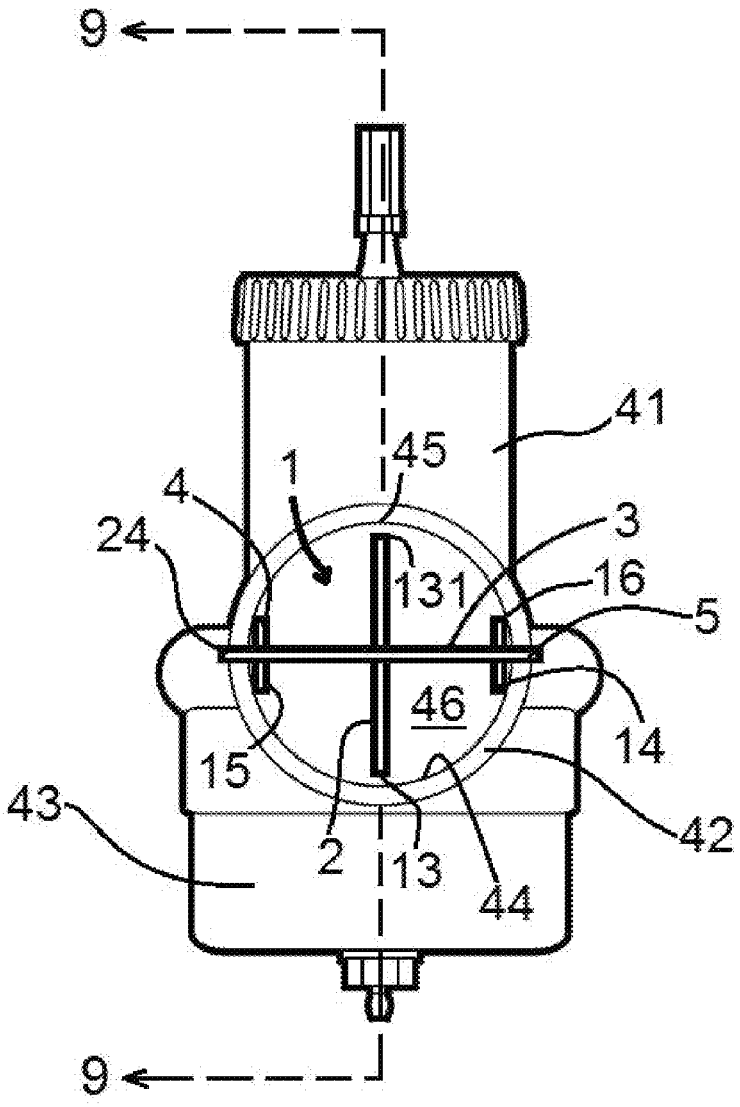
FIG. 8 is an end elevation view of the torque wing as depicted in FIG. 1, shown mounted within a carburetor throat with the throttle slide fully closed.
Figure 9:
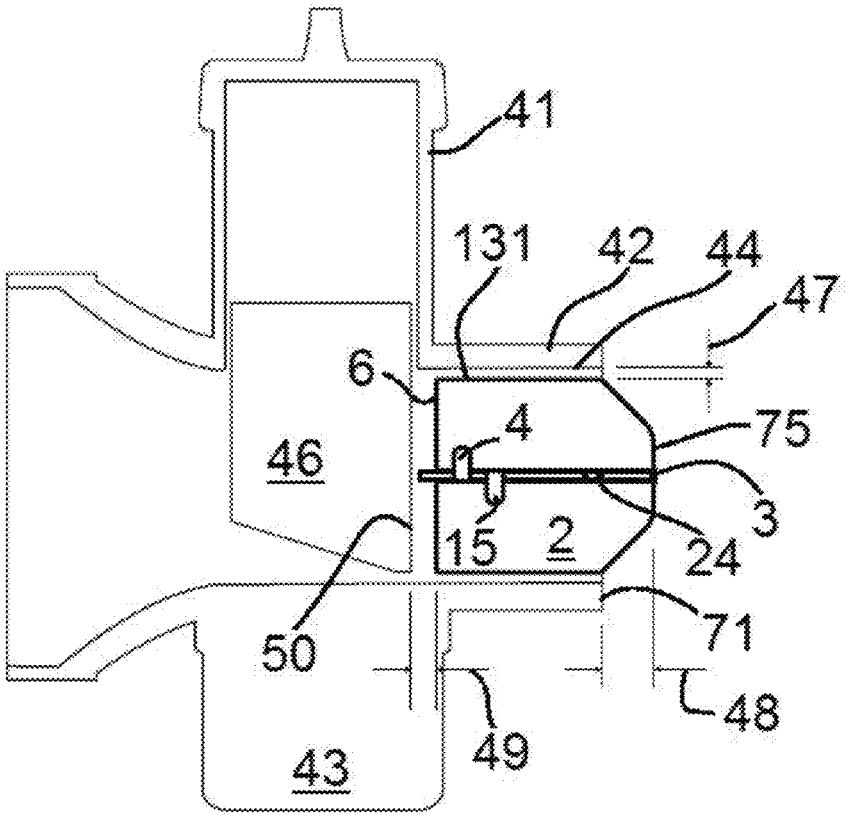
FIG. 9 is a sectional view of the torque wing taken along line 9-9 of FIG. 8.
Figure 10:
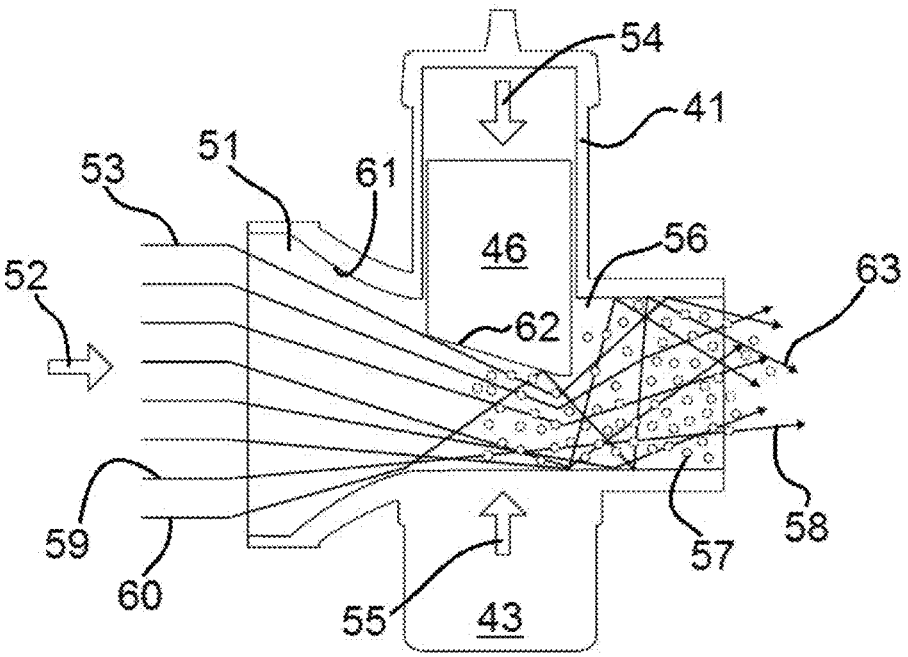
FIG. 10 is a depiction of an interior region of a prior art carburetor showing the throttle slide in a partially open position and the resultant flow of the air/fuel mixture.
Figure 11:
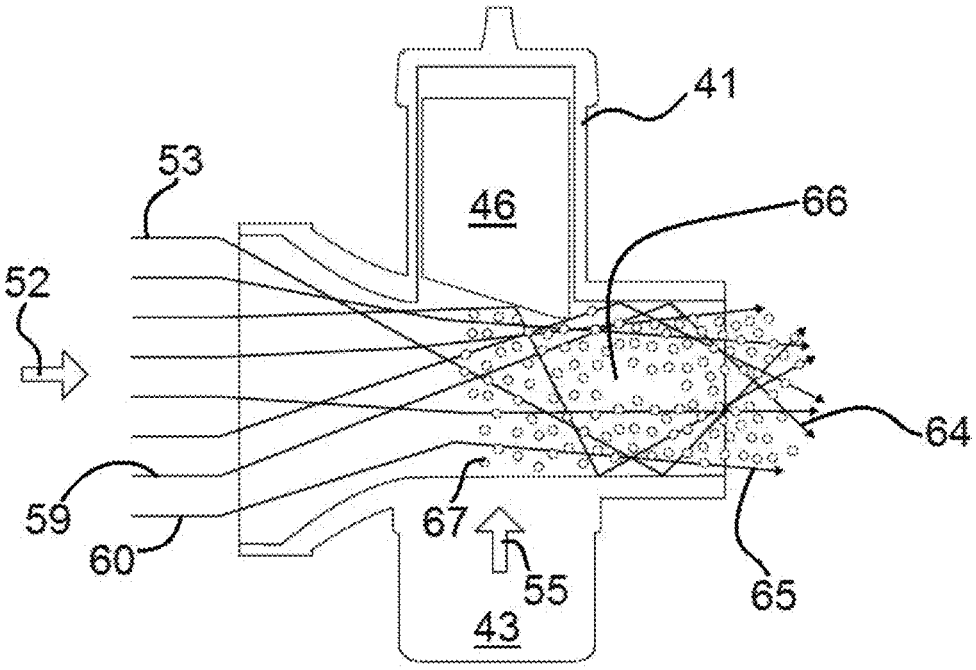
FIG. 11 is a prior art depiction of a carburetor showing the throttle slide in a fully open position and the resultant flow of the air/fuel mixture.

The torque wing 1 is shown in FIGS. 8 and 9 mounted within a round slide carburetor 41. The round slide 46 is seen to be positioned within the carburetor throat 42 above the carburetor float bowl 43. The torque wing 1 is supported in an abutting relationship with the inner wall 44 of the carburetor throat 42 by means of the locating tabs 4, 14, 15 and 16. In practice, the locating tabs may not assume the vertical position shown, but instead may be deflected slightly away from a vertical orientation in order to fit within the particular dimensions of the throat 42.

The upper edge 131 of the vertical plate 2 is seen to be spaced apart from the nearest adjacent point 45 of the inner wall 44 by a distance 47 due to the geometry imposed by the locating tabs 4, 14, 15 and 16. The magnitude of distance 45 is within the range of 0.05 to 0.10 inch. A smaller spacing tends to create the risk of an interference fit between the edge 131 and the inner wall 44, while a larger spacing tends to diminish the effectiveness of the wing 1 in preserving a channelized flow. Similarly, the lower edge 13 of plate 2 is seen to be separated from the inner wall 44 by a distance that is substantially equal to the distance 45.

The leading edge 6 of the wing 1 is spaced apart from the trailing edge 50 of the carburetor slide 46 by a distance 49. In practice the magnitude of distance 49 is in the range of 0.10 to 0.20 inch. The distance 49 is important to the proper function of wing 1 by preserving the channelized flow of both the forward and reversionary flow of the fuel/air mixture through the carburetor throat 42 while avoiding interference between the wing 1 and the slide 46.

The trailing edge 75 of the wing 1 extends beyond the trailing edge 71 of the carburetor by a distance 48. The path followed by the fuel/air mixture leaving the carburetor 41 can be highly variable depending upon the mounting of the carburetor with respect to an internal combustion engine on a specific motor vehicle, which necessarily dictates the geometry and placement of the intake manifold. In a typical installation, the distance 48 is approximately one inch, but in other cases could be lengthened substantially if the intake manifold permitted. In the case of a two cycle engine, the distance 48 may be great enough to permit the trailing edge 75 to extend substantially the entire distance between the carburetor trailing edge 71 and the intake valve at the engine itself.

Figure 12:
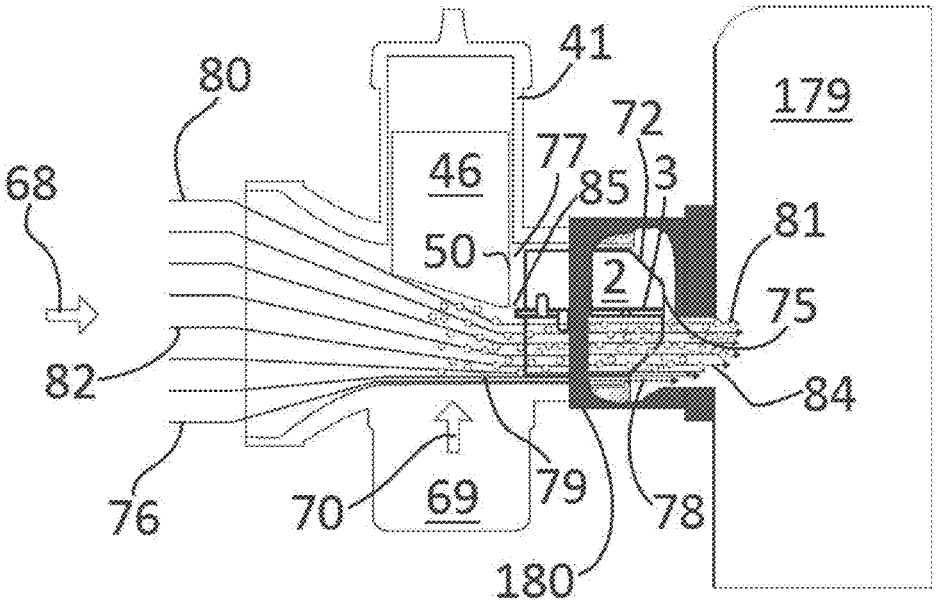
FIG. 12 is a sectional view taken along line 9-9 in FIG. 8, with additional components added for clarity, showing the throttle slide in a partially open position and the resultant flow of the air/fuel mixture.
Figure 13:
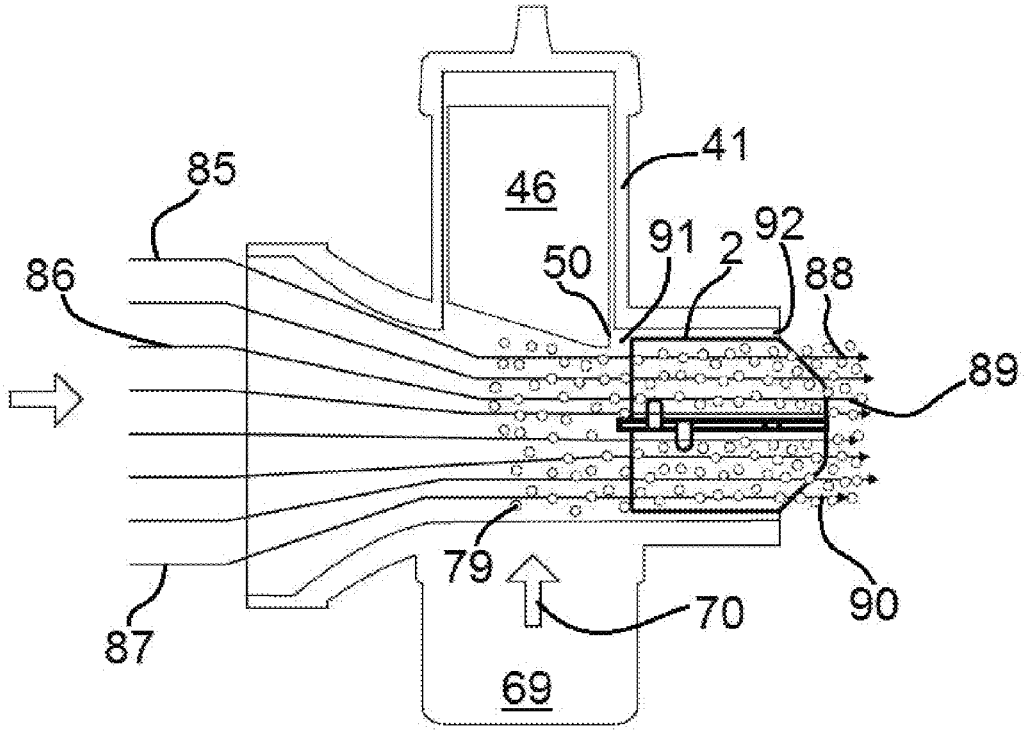
FIG. 13 is a sectional view taken along line 9-9 in FIG. 8 showing the throttle slide in a substantially fully open position and the resultant flow of the air/fuel mixture.
Figure 14:
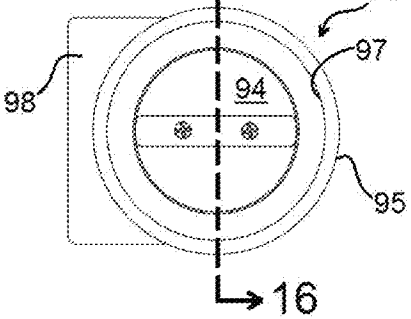
PRIOR ART FIGURE 14
FIG. 14 is a front elevation of a prior art throttle body as used in a fuel injected engine.
Figure 15:
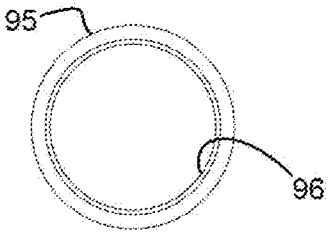
PRIOR ART FIGURE 15
FIG. 15 is a rear elevation of a prior art throttle body as used in a fuel injected engine.
Figure 16:
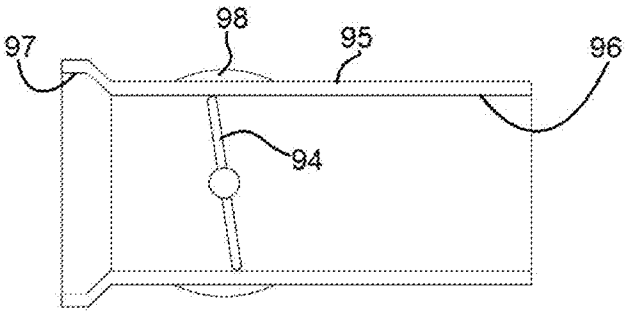
PRIOR ART FIGURE 16
FIG. 16 is a sectional view taken along line 16-16 in FIG. 14 showing the throttle plate in a substantially closed position.

The operation of the torque wing 1 can be better appreciated with reference to FIGS. 12 and 13. With the throttle slide 46 approximately half open as depicted in FIG. 12, air enters the carburetor 41 in the direction of arrow 68, entraining fuel particles 79 exiting from the float chamber 69 and moving initially in the direction of arrow 70. Three exemplary airflow entry paths 76, 80 and 82 are depicted.

The air/fuel mixture associated with path 76 exits the carburetor along path 78. Similarly, the air/fuel mixture associated with path 82 exits the carburetor along path 84, while the air/fuel mixture associated with path 80 exits the carburetor along path 81. All of the paths exiting the carburetor 41 pass through a separable intake manifold portion 180 affixed to engine 179 and are substantially parallel to each other as well as the horizontal plate 3 of the wing 1. The region 77 immediately following the trailing edge 50 of the throttle slide 46 receives substantially none of the air/fuel mixture. This greatly attenuated flow in region 77 occurs because the flow path defined by the region 77 and the gap 85 residing between trailing edge 50 and horizontal plate 3 represents a relatively high pressure region in comparison to the relatively low pressure region occupied by flow paths 78, 81 and 84.

With the throttle slide 46 approximately fully open as depicted in FIG. 13, air enters the carburetor 41 in the direction of arrow 68, entraining fuel particles 79 exiting from the float chamber 69 and moving initially in the direction of arrow 70. Three exemplary airflow entry paths 85, 86 and 87 are depicted. The air/fuel mixture associated with path 85 exits the carburetor along path 88. Similarly, the air/fuel mixture associated with path 86 exits the carburetor along path 89, while the air/fuel mixture associated with path 87 exits the carburetor along path 90.

All of the paths exiting the carburetor 41 are substantially parallel to each other as well as the vertical plate 2 of the wing 1. The gap 91 immediately following the trailing edge 50 of the throttle slide 46 receives substantially none of the air/fuel mixture because the flow path through the gap 91 represents a relatively high pressure region in comparison to the relatively low pressure region occupied by flow paths 88, 89 and 90. The region 92 adjacent to the vertical plate 2 does not support substantial flow of the air/fuel mixture, but does provide a path for the equalization or orderly propagation of any reversionary waves caused by the combustion process, thereby minimizing the effect of the reversionary wave on the channelized flow represented by flow paths 88, 89 and 90.

Figure 17:
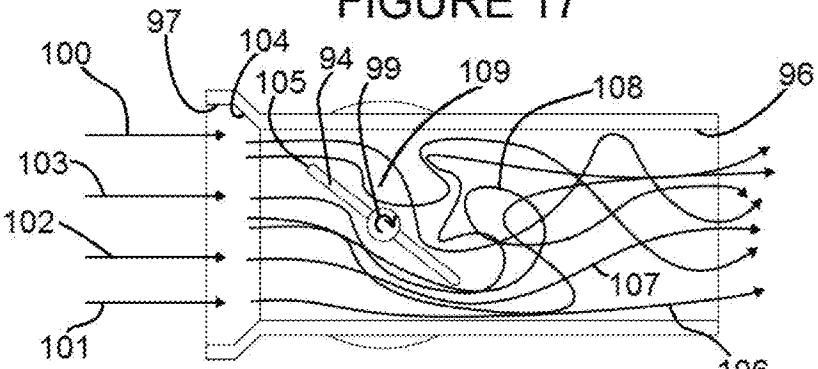
FIGURE 17 PRIOR ART
FIG. 17 is a sectional view taken along line 16-16 in FIG. 14 showing the throttle plate in a partially open position.
Figure 18:
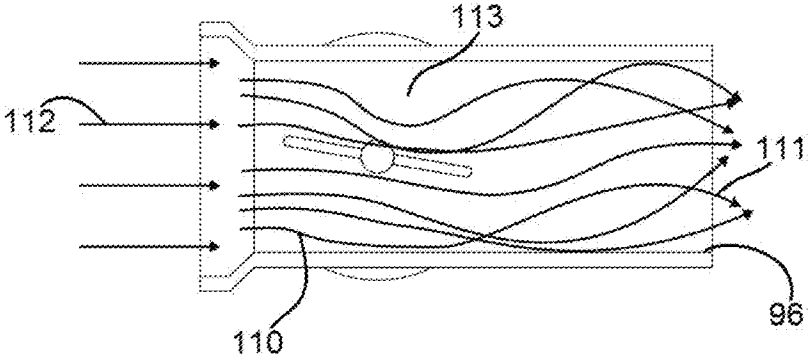
PRIOR ART FIGURE 18
FIG. 18 is a sectional view taken along line 16-16 in FIG. 14 showing the throttle plate approaching a fully open position.
Figure 19:
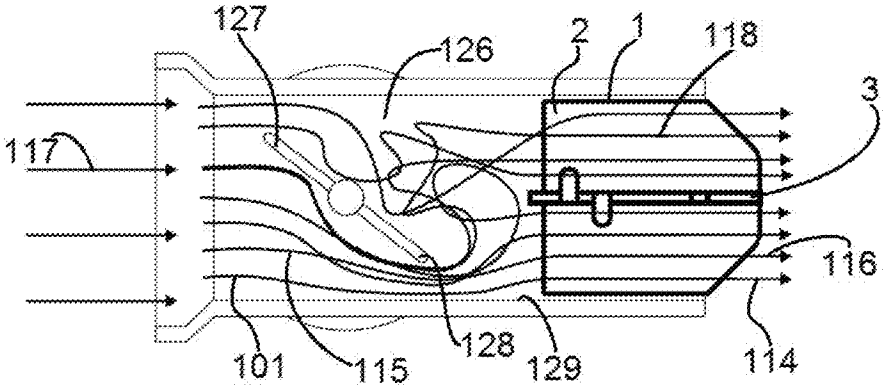
FIG. 19 depicts the throttle body of FIG. 17 shown with the torque wing of the present invention installed in the throttle body throat.
Figure 20:
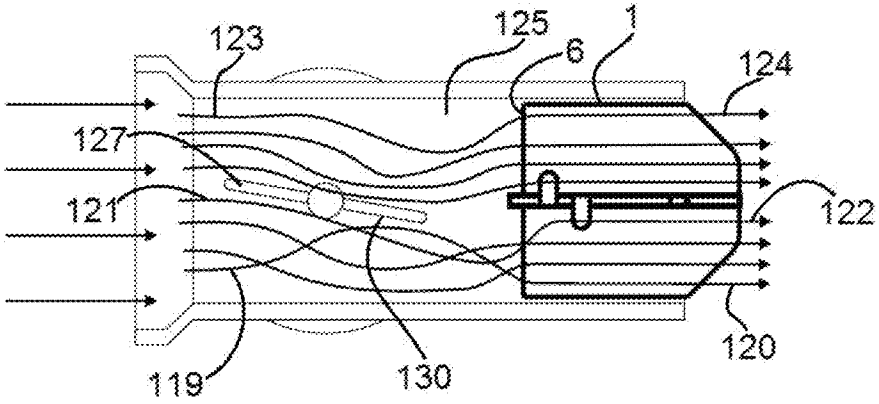
FIG. 20 depicts the throttle body of FIG. 18 shown with the torque wing of the present invention installed in the throttle body throat.

Referring also to FIGS. 19 and 20, the beneficial effect of the torque wing 1 when used in conjunction with a throttle body can be observed. When the butterfly valve 127 is approximately half closed as shown in FIG. 19, the entry path 101, also depicted in FIG. 17, is displaced toward the inner wall 129 due to the effect of the trailing edge 128 of valve 127. However, the exit path 114 has assumed a uniformly parallel orientation that is substantially collinear with the entry path 101.

The adjacent entry path 115 is also displaced by the presence of trailing edge 128, but adopts an exit path 116 when passing by the vertical plate 2 and horizontal plate 3, the exit path 116 being substantially parallel to the adjacent exit path 114. The entry path 117 is substantially deflected by the presence of the butterfly valve 127, travelling around the trailing edge 128 and entering a region 126 of relatively low pressure. However, the exit path 118 becomes parallel to exit paths 116 and 114 upon reaching plates 2 and 3.

FIG. 20 depicts the butterfly valve 127 in a substantially fully open position. The entry path 119 is displaced toward the valve 127 and particularly toward the trailing surface 130. The exit path 120, however, assumes a parallel orientation to the plates 2 and 3 upon reaching the torque wing 1. Entry path 121 follows an irregular path until the exit path 122 passes by the trailing edge 6, whereupon path 122 rapidly approaches an orientation that is parallel to exit path 120. Entry path 123 is deflected by the void region 125 until encountering trailing edge 6. The resultant exit path 124 is substantially parallel to all of the other exit paths, such as paths 120 and 122, for example.

Figure 21:
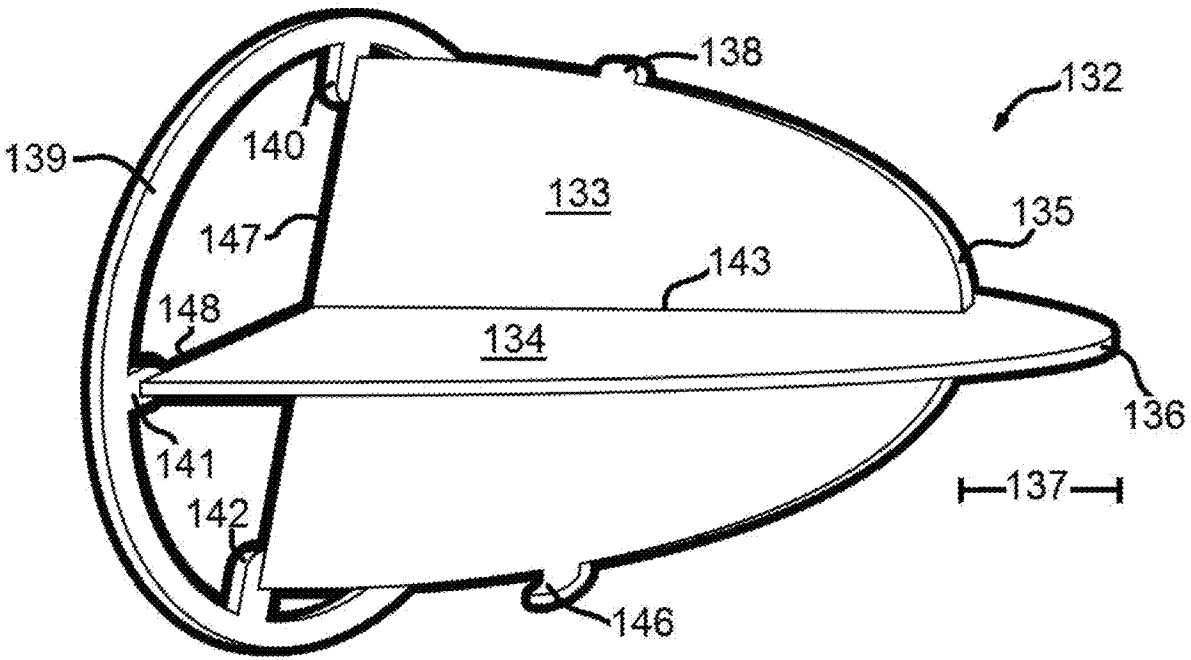
FIG. 21 is a perspective view of an alternate embodiment of a torque wing constructed according to the principles of the present invention.
Figure 23:
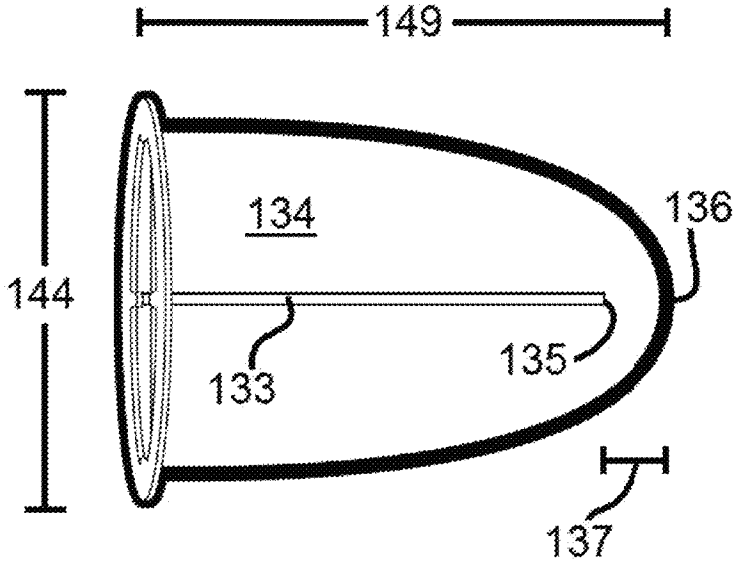
FIG. 23 is a top view of the torque wing illustrated in FIG. 22.
Figure 22:
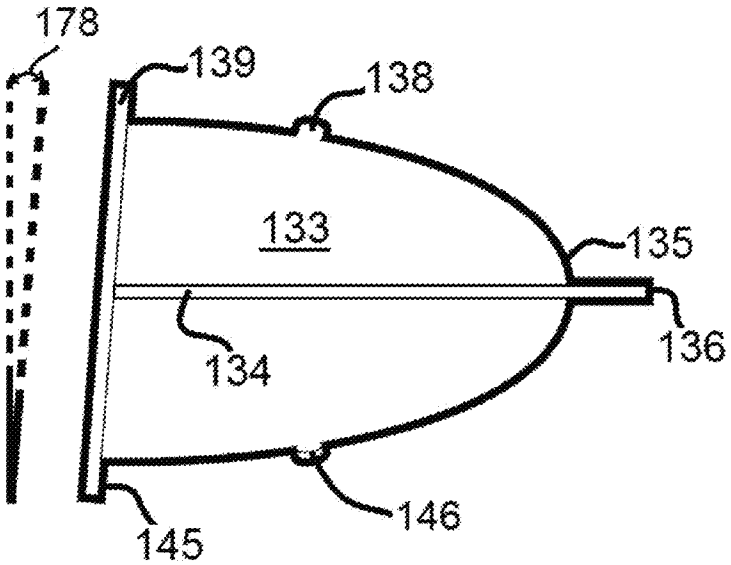
FIG. 22 is a side view of the torque wing illustrated in FIG. 21.

Referring also to FIGS. 21, 22 and 23, an additional embodiment of the present invention is presented. The torque wing 132 is formed to with a substantially circular locking ring 139, the ring 139 being adapted to mate with the intake manifold structure of some throttle body and cylinder head geometries. Extending from the locking ring 139 is a series of symmetrically spaced tabs such as tabs 140, 141 and 142 that serve as a mounting point for the horizontal wing 134 and the substantially orthogonal vertical wing 133. The vertical wing 133 joins the horizontal wing 134 along a substantially continuous seam 143. The vertical wing 133 is shaped generally as a partial ellipse having a leading edge 147 that abuts and is affixed to the tabs 140 and 142.

The remainder of the vertical wing 133 is defined by a tapering trailing edge 135. Extending from the trailing edge 135 is a series of locating tabs, such as locating tab 138 and 146, both of which tend to align the seam 143 with any longitudinal axis that may exist within a particular intake manifold structure. As best seen in FIG. 22, the seam locking ring 139 is inclined or tilted by an angle 178 with respect to the horizontal wing 134 that is substantially equal to any tilt that may exist in a particular intake manifold geometry. As seen in FIG. 23, the locking ring 139 has a diameter 144 that is selected to be somewhat greater than the expected diameter of a particular intake manifold structure, thereby forming a lip 145 that will be gripped during use between a throttle body intake port and the upstream portion of the intake manifold.

The horizontal wing 134 is formed to include a leading edge 148 that is substantially coplanar with the leading edge 147 of the vertical wing 133. The horizontal wing 134 also includes a substantially continuous trailing edge 136, the horizontal wing having a length 149 that causes the trailing edge 136 to extend beyond the trailing edge 135 of the vertical wing 133 by a distance 137. The portion of the horizontal wing 134 that resides within the distance 137 permits the air/fuel mixture to exit the torque wing 132 in a relatively more stable manner by avoiding a sudden transition across the two trailing edge structures 135 and 136 simultaneously.

Figure 24:
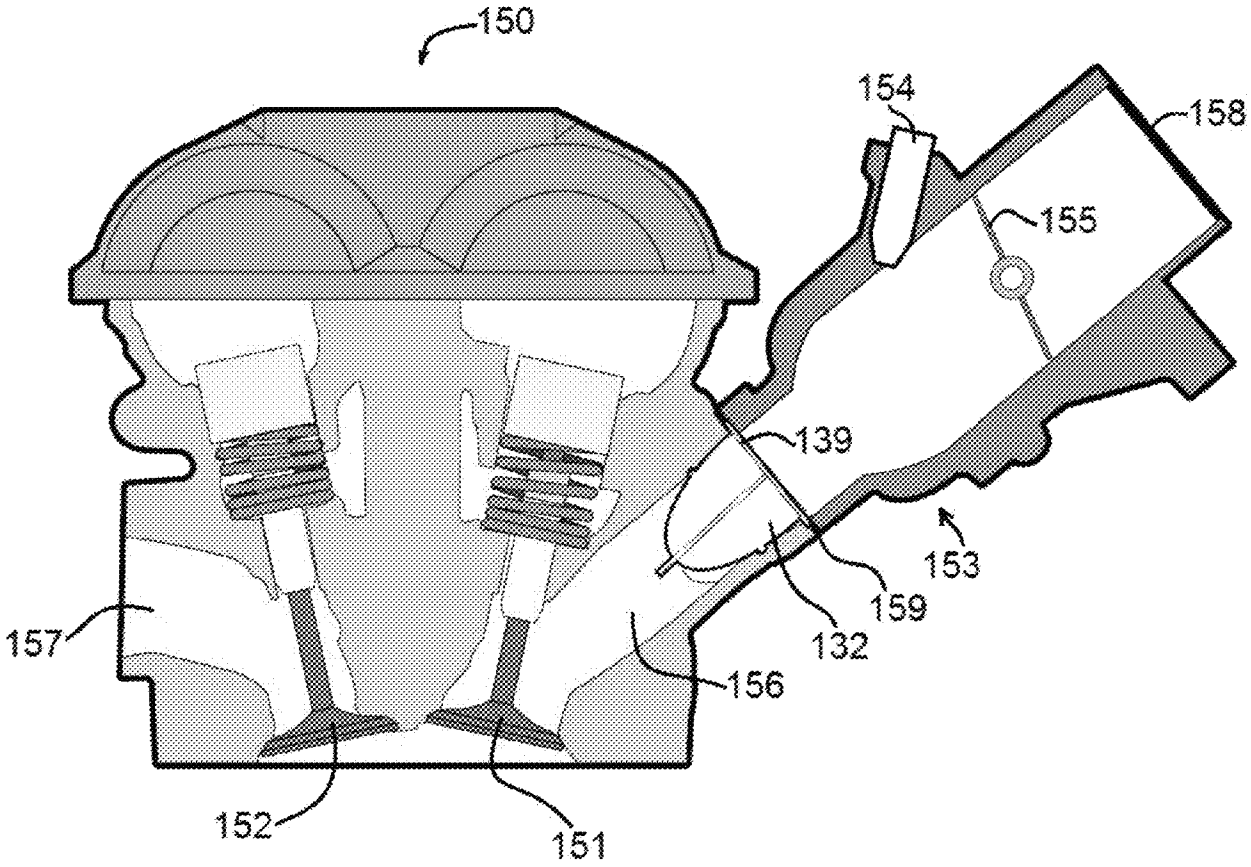
FIG. 24 is a side view of the torque wing illustrated in FIG. 22, shown mounted in an intake manifold attached to the cylinder head of an internal combustion engine, with some portions of the intake manifold and cylinder head removed for clarity.

Referring also to FIG. 24, the use of the torque wing 132 may be more fully understood. The cylinder head structure 150 of a cylinder used in an internal combustion engine is shown, including the intake path 156, the intake valve 151, the exhaust valve 152 and the exhaust manifold 157. A fuel/air mixture is introduced into the intake path 156 by means of the throttle body 153, which joins the intake path at interface 159. The throttle body 153 includes a fuel injector 154 and an air control valve 155, the air entering the throttle body 153 through the opening 158. The torque wing 132 is mounted between the throttle body 153 and the intake path 156, the lip 145 of the lock ring 139 being secured along the interface 159 between the intake path 156 and the throttle body 153.

Figure 25:
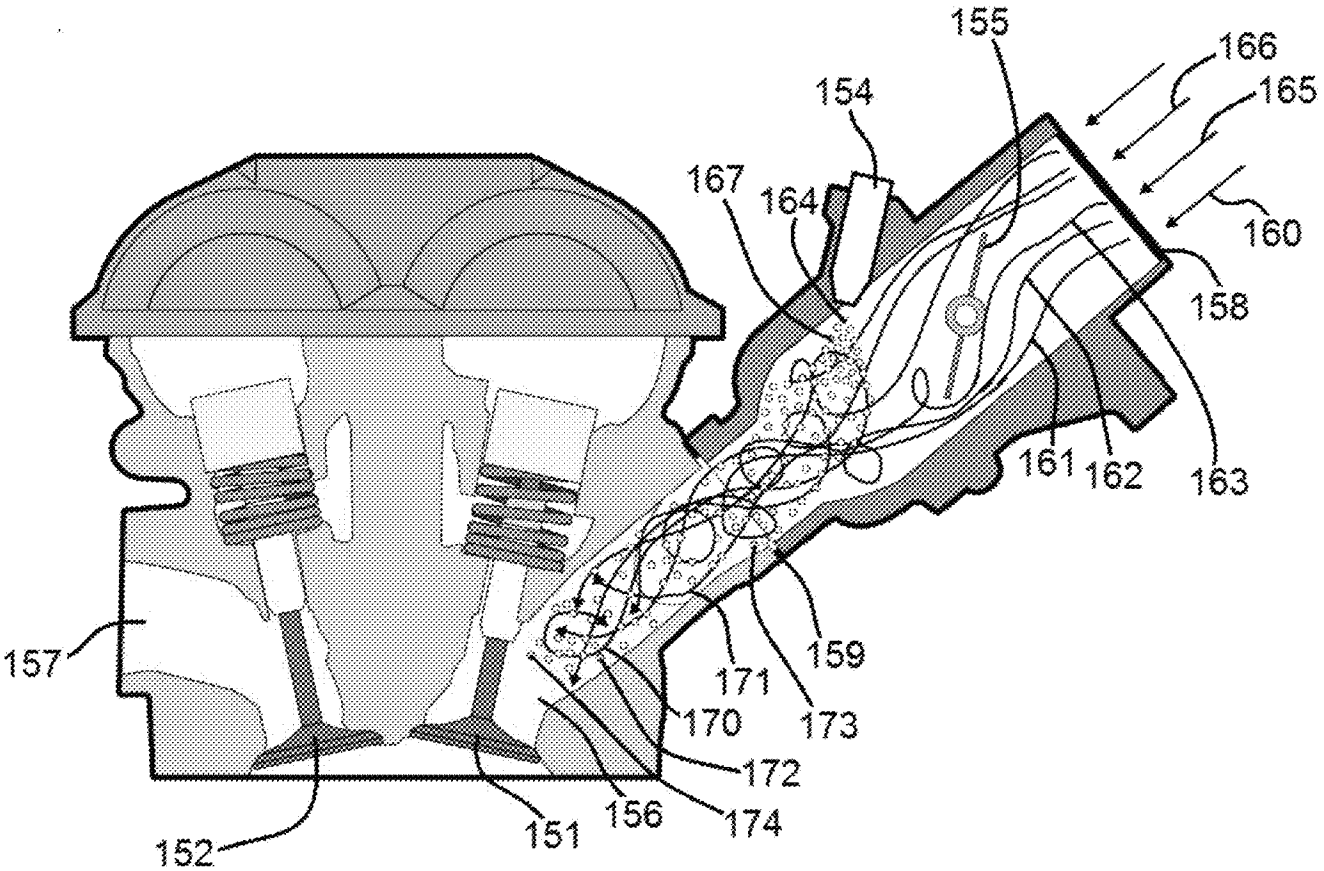
FIG. 25 is a side view of an intake manifold attached to the cylinder head of an internal combustion engine as depicted in FIG. 24, but without the presence of the torque wing illustrated in FIG. 21.

FIG. 25 illustrates the arrangement shown in FIG. 24, but without the presence of the torque wing 32 and with the additional depiction of the flow of an air/fuel mixture through the throttle body 153 and the intake path 156. Air is shown entering the throttle body through the opening 158 along substantially parallel paths such as, for example, paths 160, 165 and 166. As the air enters the throttle body 153, the partially open air control valve 155 creates an obstacle to the incoming air, thereby causing the air to follow, for example, meandering curved paths 161, 162 and 163. Fuel, as indicated by fuel droplets 164 and 167, for example, is introduced downstream of the air control valve 155 by the fuel injector 154. A chaotic air/fuel mixture is formed downstream of the air control valve 155 as manifested by the tortuous air flow paths 170 and 171, which are also indicative of substantial velocity variations within the downstream air/flow mixture. Within the intake path 156 the random distribution of individual fuel droplets is apparent by the position, for example, of the fuel droplets 172, 173 and 174.

Figure 26:
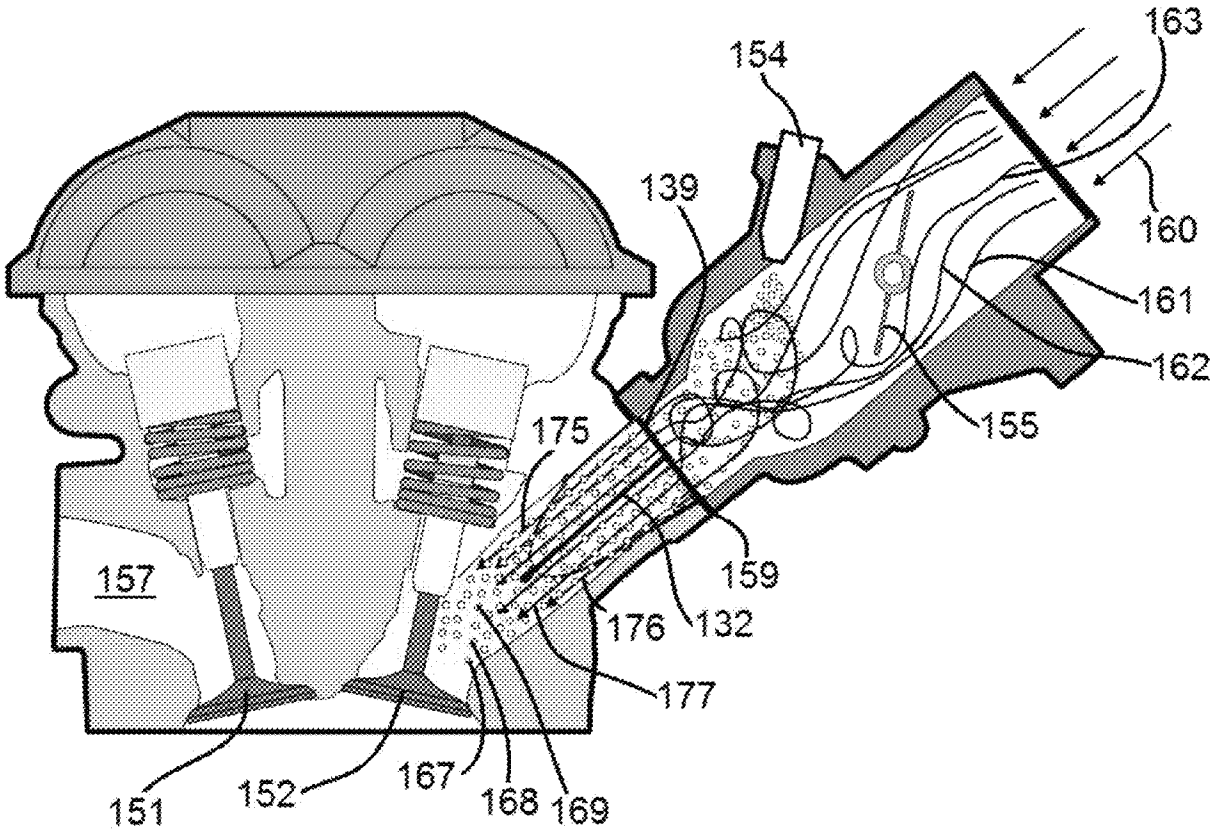
FIG. 26 is a side view of the torque wing illustrated in FIG. 24, depicting airflow through the intake manifold and into the cylinder head of an internal combustion engine, with some portions of the intake manifold and cylinder head removed for clarity.

The effect of the torque wing 132 on air/fuel mixture flow within the intake path 156 is depicted in FIG. 26. The air flow paths, such as flow paths 175, 176 and 177, are substantially parallel along the intake path 156 and have assumed a largely laminar nature throughout the cross section of the intake path. The orderly distribution of the fuel droplets 167, 168 and 169 are consistent with the maintenance of a laminar flow condition downstream from the torque wing 132.

In the preferred embodiment of the present invention, the torque wing 1 is composed of metal. However, the use of plastic materials is also acceptable if they are sufficiently durable to withstand continued exposure to the carburetor environment. The use of ceramic materials is also possible, especially if the manufacturing tolerances of the carburetor or throttle body throat is sufficiently well defined that the locating and spacing tabs do not need to deflect in order to provide a secure fit while maintaining the desired spacing from the carburetor or throttle body wall. While particular ranges of spacing between the edges of the torque wing 1 and the surrounding wall and throttle elements have been specified, variations in spacing may be required in particular installations.

The geometry of the upper, lower and trailing edges may deviate from a continuous straight or curved line in order to accommodate protruding features within the carburetor throat or cylinder head inlet path. In some applications a serrated edge or orthogonal lip may provide improved interaction with a reversionary pulse wave. Further, the length of the torque wing may vary substantially from the dimensions shown. Ideally, the length of the torque wing occupies substantially the entire length of the intake manifold. In practice, the relatively short torque wing illustrated is an example of a universal device that is adaptable to a wide variety of intake manifold geometries, as is appropriate for a device intended to be retrofitted in an existing engine installation. However, in those situations where the torque wing is to be installed during original equipment manufacturing and installation, the torque wing may be shaped to occupy almost all of a relatively lengthy and tortuous intake manifold shape. In any event, the appended claims define the scope of the invention.

I claim:

1. A wing intended for use within a portion of an engine intake manifold downstream of a throttle valve, the portion of the intake manifold having a diameter, an exit orifice and a longitudinal axis, the wing comprising:

(a) a substantially planar, flat vertical plate, the substantially planar, flat vertical plate being substantially parallel with the longitudinal axis; and (b) a substantially planar, flat horizontal plate, the substantially planar, flat vertical plate and the substantially planar, flat horizontal plate dividing the portion of the intake manifold in which the wing resides into a plurality of discrete parallel channels.

2. The wing of claim 1, wherein the vertical plate further comprises a planar surface having a width, the width being equal to approximately ninety five percent of the diameter of the portion of the intake manifold in which the wing is to be used.

3. The wing of claim 2, wherein the vertical plate further comprises:

(a) a top edge; and (b) a bottom edge, the bottom edge being substantially parallel to the top edge, both the top edge and the bottom edge being formed so as to reside a substantially equal distance from an inner intake manifold wall of an intake manifold in which the wing is to be used.

4. The wing of claim 3, wherein the substantially equal distance from the inner intake manifold wall of the top edge and the bottom edge is in the range of 0.01 inch to 0.30 inch.

5. The wing of claim 4, wherein the horizontal plate further comprises:

(a) a left edge; and (b) a right edge, the right edge being substantially parallel to the left edge, both the right edge and the left edge being formed so as to reside a substantially equal distance from an intake manifold wall of an intake manifold in which the wing is to be used.

6. The wing of claim 5, wherein the substantially equal distance from the intake manifold wall of the left edge and the right edge is in the range of 0.01 inch to 0.30 inch.

7. The wing of claim 6, wherein the vertical plate bisects the horizontal plate, thereby dividing an intake manifold in which the wing resides into four channels.

8. The wing of claim 7, wherein the horizontal plate further comprises a trailing edge, the trailing edge being contoured to maintain a substantially uniform spaced apart relationship from a throttle valve formed as a throttle plate.

9. The wing of claim 8, wherein the horizontal plate further comprises at least one pair of locating tabs, a first one of the locating tabs extending outwardly from the left edge of the horizontal plate, a second one of the locating tabs extending outwardly from the right edge of the horizontal plate, each of the first and second locating tabs being formed so as to permit an abutting relationship an inner intake manifold wall of an intake manifold in which the wing is to be used.

10. The wing of claim 9, wherein the horizontal plate further comprises at least one pair of securing tabs, a first one of the securing tabs extending outwardly from the left edge of the horizontal plate, a second one of the securing tabs extending outwardly from the right edge of the horizontal plate, each of the first and second securing tabs being formed so as to create an abutting relationship with a portion of a mating structure joining the intake manifold to an adjacent fuel/air mixing device.

11. The wing of claim 10, wherein the horizontal plate has a maximum length that is greater than a distance between a throttle plate and an exit orifice of a fuel/air mixing device in which the wing resides, a portion of the horizontal plate of the wing thereby extending into a separable intake manifold portion that is connected to a fuel/air mixing device.

12. The wing of claim 11, wherein the vertical plate has a maximum length that is greater than a distance between a throttle plate and an exit orifice of a fuel/air mixing device in which the wing resides, a portion of the vertical plate of the wing thereby extending into a separable intake manifold portion that is connected to a fuel/air mixing device.

13. A wing intended for use within a portion of an engine intake manifold downstream of a throttle valve, the portion of the intake manifold having a diameter, an exit orifice and a longitudinal axis, the wing comprising:

(a) a vertical plate, the vertical plate further comprising:
  (i) a planar surface having a width, the width being equal to approximately ninety five percent of the diameter of the portion of the intake manifold in which the wing is to be used;
  (ii) a top edge; and
  (iii) a bottom edge, the bottom edge being substantially parallel to the top edge, both the top edge and the bottom edge being formed so as to reside a substantially equal distance in the range of 0.01 inch to 0.03 inch from an inner intake manifold wall of an intake manifold in which the wing is to be used, wherein the vertical plate has a maximum length that is greater than a distance between a throttle plate and an exit orifice of a fuel/air mixing device in which the wing resides, a portion of the vertical plate of the wing thereby extending into a separable intake manifold portion that is connected to a fuel/air mixing device;

(b) a horizontal plate, the horizontal plate further comprising:
  (i) a left edge;
  (ii) a right edge, the right edge being substantially parallel to the left edge, both the right edge and the left edge being formed so as to reside a substantially equal distance in the range of 0.01 inch to 0.03 inch from an intake manifold wall of an intake manifold in which the wing is to be used, the vertical plate and the horizontal plate dividing the portion of the intake manifold in which the wing resides into a plurality of discrete channels, wherein the vertical plate bisects the horizontal plate, thereby dividing an intake manifold in which the wing resides into four channels;
  (iii) a trailing edge, the trailing edge being contoured to maintain a substantially uniform spaced apart relationship from a throttle valve formed as a throttle plate;
  (iv) at least one pair of locating tabs, a first one of the locating tabs extending outwardly from the left edge of the horizontal plate, a second one of the locating tabs extending outwardly from the right edge of the horizontal plate, each of the first and second locating tabs being formed so as to permit an abutting relationship with an inner intake manifold wall of an intake manifold in which the wing is to be used;
  (v) at least one pair of securing tabs, a first one of the securing tabs extending outwardly from the left edge of the horizontal plate, a second one of the securing tabs extending outwardly from the right edge of the horizontal plate, each of the first and second securing tabs being formed so as to create an abutting relationship with a portion of a mating structure joining the intake manifold to an adjacent fuel/air mixing device, wherein the horizontal plate has a maximum length that is greater than a distance between a throttle plate and an exit orifice of a fuel/air mixing device in which the wing resides, a portion of the horizontal plate of the wing thereby extending into a separable intake manifold portion that is connected to a fuel/air mixing device; wherein the maximum length of the horizontal plate and the maximum length of the vertical plate is substantially equal.

14. A method of improving torque continuity in a vehicle using a carburetor, comprising the steps of:
  (a) forming a wing as two flat, substantially orthogonal plates within a carburetor throat;
  (b) integrally forming a plurality of locating tabs along an edge region of the substantially orthogonal plates;
  (c) mounting a the wing within the carburetor throat such that the locating tabs create a spaced apart relationship between the edge region of the substantially orthogonal plates and an adjacent inner wall of the carburetor throat; and
  (d) spacing a leading edge of the wing from a carburetor throttle plate so as to create a gap of approximately 0.10 inch between the leading edge and the carburetor throttle plate.

15. The method of claim 14, further comprising the step of spacing a top edge and a bottom edge of one of the two orthogonal plates so as to create a gap of approximately 0.10 inch between the top edge and an adjacent inner wall of the carburetor throat.

16. The method of claim 15, further comprising the step of forming a plurality of protruding tabs on a left edge and a right edge of one of the two orthogonal plates so as to prevent longitudinal movement of the wing within the carburetor throat.

* * * * *